United States Patent [19]

Ito et al.

[11] Patent Number: 4,742,964

[45] Date of Patent: May 10, 1988

[54] ELECTROMAGNETIC FUEL INJECTOR

[75] Inventors: Hideki Ito; Motohiro Baba; Hitoshi Takeuchi; Toshiro Makimura; Takaaki Takagi, all of Obu, Japan

[73] Assignee: Aisan Kogyo Kabushiki Kaisha, Obu, Japan

[21] Appl. No.: 922,170

[22] Filed: Oct. 23, 1986

[30] Foreign Application Priority Data

Oct. 30, 1985 [JP] Japan ..... 60-243279
Dec. 9, 1985 [JP] Japan ..... 60-189486
Dec. 9, 1985 [JP] Japan ..... 60-189487

[51] Int. Cl.[4] ..... B05B 15/00; B05B 1/30; F02M 61/14

[52] U.S. Cl. ..... 239/397.5; 239/551; 239/585; 123/470

[58] Field of Search ..... 239/585, 397.5, 550, 239/551, 127.1, 132; 137/338; 251/129.21; 123/470

[56] References Cited

U.S. PATENT DOCUMENTS 1,294,417 2/1919 Dady ..... 137/338
3,695,235 10/1972 Anderson ..... 239/533.1
4,116,389 9/1978 Furtah et al. ..... 239/585
4,240,384 12/1980 Urbinati et al. ..... 123/470
4,240,468 12/1980 Brand et al. ..... 251/129.21
4,483,485 11/1984 Kamiya et al. ..... 239/585

FOREIGN PATENT DOCUMENTS 2833090 2/1980 Fed. Rep. of Germany ... 239/397.5
52-55020 5/1977 Japan .
56-138151 10/1981 Japan .
57-35460 2/1982 Japan .
57-178164 11/1982 Japan .
58-29161 2/1983 Japan .
58-70455 5/1983 Japan .
59-2981 1/1984 Japan .
59-73571 5/1984 Japan .
596911 1/1948 United Kingdom ..... 239/397.5

*Primary Examiner*—Andres Kashnikow
*Assistant Examiner*—Karen B. Merritt
*Attorney, Agent, or Firm*—Dennison, Meserole, Pollack & Scheiner

[57] ABSTRACT

An electromagnetic fuel injector comprising a fixed iron core, a solenoid formed by winding a coil around the fixed iron core, a coil holder fixed to the solenoid, an injector casing surrounding the solenoid and the coil holder and formed of a material having high magnetic permeability, a movable iron core inserted between the fixed iron core and the injector casing, a compression spring normally biasing the movable iron core toward an injection nozzle of the injector, a valve body connected at its base to the movable iron core and formed with a flange at a base portion thereof, a stopper adapted to abut against the flange of the valve body and restrict a movable range, a valve housing incorporated in a front portion of the injector casing and slidably supporting the valve body, the valve housing being formed at its front end portion with a valve seat adapted to abut against the valve body, and a radiation member closely fitted on an outer periphery of the injector casing. A connection member may be provided connecting a plurality of injectors mounted on cylinders in a multi-cylinder engine for radiating heat generated in the injectors.

14 Claims, 12 Drawing Sheets

ELECTROMAGNETIC FUEL INJECTOR

BACKGROUND OF THE INVENTION

The present invention relates to an electromagnetic fuel injector for an internal combustion engine in automotive vehicles, and more particularly to a radiation device for radiating heat in the electromagnetic fuel injector and preventing overheat of the fuel injector.

Generally, the fuel injector is mounted on a cylinder head of the internal combustion engine, and it tends to be overheated by the heat transmitted from the internal combustion engine. When temperature of the fuel injector is increased to exceed a certain level, fuel starts vaporizing in the fuel injector to generate a so-called vapor lock and thereby hinder supply of the fuel. As a result, high-temperature characteristics of the internal combustion engine are lowered. To avoid such a defect, the prior art proposed a system wherein the fuel injector is covered with a heat insulator, or the fuel injector itself is provided with a heat insulating means to suppress heat transmission from the internal combustion engine. Such a conventional construction is disclosed in Japanese Laid-Open Utility Model Publication Nos. 56-138151, 57-178164, 58-70455 and 58-29161.

The prior art further proposed a system wherein cooling water is circulated in a fuel injector using alcohol as the fuel. This construction is disclosed in Japanese Laid-Open Utility Model Publication No. 57-35460.

However, it is difficult to completely radiate the heat by the method of covering the fuel injector with the heat insulator, and the method is not so effective under various conditions.

In a conventional electromagnetic fuel injector, an external resistor is inserted between a battery and the fuel injector, so as to suppress excessive current greater than a predetermined value from flowing in an electromagnetic solenoid and resistance heat generation of the solenoid, and thereby prevent a coil cover from being molten. However, the provision of the resistor causes an increase in costs, and it is troublesome to treat the heat generated in the external resistor. To cope with this, it has been proposed that the solenoid coil itself is designed to have a resistor function of restricting current, thereby eliminating the need for any external resistor. This construction is disclosed in Japanese Laid-Open Patent Publication No. 52-55020 and Japanese Laid-Open Utility Model Publication Nos. 59-2981 and 59-73571.

However, in the conventional construction, the solenoid itself functions as a heat generator, and accordingly, even when the fuel injector is covered with the heat insulator, a heat insulating effect is not exhibited at all, but conversely the heat insulator functions harmfully.

Although the aforementioned method of circulating the cooling water in the fuel injector is effective to prevent overheating of the fuel injector, fine working of the fuel injector is required to increase costs.

SUMMARY OF THE INVENTION

It is a primary object of the present invention to provide an electromagnetic fuel injector which may effectively radiate the heat transmitted from the engine to thereby prevent the fuel injector from being overheated.

It is another object of the present invention to provide an electromagnetic fuel injector which may prevent vapor lock of fuel and eliminate reduction in high-temperature characteristics of the engine.

It is a further object of the present invention to provide an electromagnetic fuel injector which may effectively radiate the heat generated by a solenoid coil located in the fuel injector and thereby prevent a coil cover from being molten.

The electromagnetic fuel injector according to the present invention comprises a fixed iron core, a solenoid formed by winding a coil around the fixed iron core, a coil holder fixed to the solenoid, an injector casing surrounding the solenoid and the coil holder and formed of a material having high magnetic permeability, a movable iron core inserted between the fixed iron core and the injector casing, a compression spring normally biasing the movable iron core to an injection nozzle of the injector, a valve body connected at its base to the movable iron core and formed with a flange at a base portion thereof, a stopper adapted to abut against the flange of the valve body and restrict the range of movement of the valve body, a valve housing incorporated in a front portion of the injector casing and slidably supporting the valve body, the valve housing being formed at its front end portion with a valve seat adapted to abut against the valve body, and a radiation member closely fitted on an outer periphery of the injector casing.

According to the present invention, there is further provided a connection member for connecting a plurality of fuel injectors mounted on cylinders of a multi-cylinder engine, the connection member having a radiating function of radiating the heat generated in the fuel injectors.

The invention will be more fully understood from the following detailed description and appended claims when taken with the drawings.

DETAILED DESCRIPTION OF THE PREFERRED EMBODIMENTS

First Embodiment

Figure 1A:
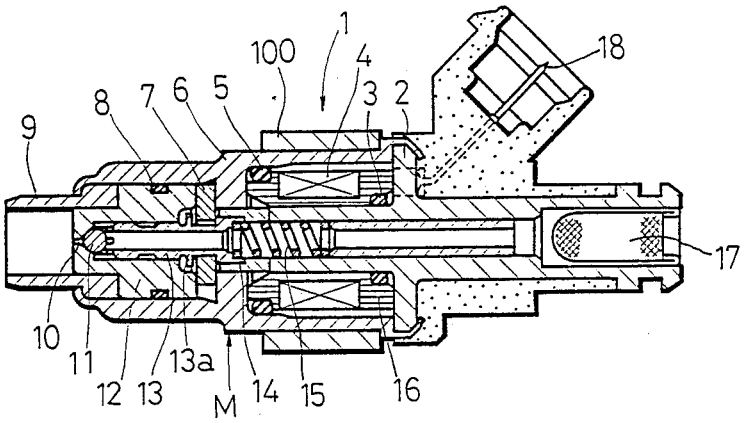
FIG. 1A is a vertical sectional view of the fuel injector of a first preferred embodiment of the invention.

Referring to FIG. 1A, reference numeral 1 designates an electromagnetic fuel injector provided with a radiation cover 100. A solenoid 4 is formed by winding a coil around a fixed iron core 2, and is fixed by a coil holder 16. The solenoid 4 and the coil holder 16 are fixedly mounted in a space between the fixed iron core 2 and an injector casing 6. The injector casing 6 is formed of a material having high magnetic permeability (steel containing aluminum, chromium or silicon, etc., namely, magnetic stainless steel). A movable iron core 14 is inserted between the fixed iron core 2 and the injector casing 6 to form a magnetic circuit. The movable iron core 14 is normally biased by a compression spring 15 toward an injection nozzle of the injector 1. When power is supplied through an external connection terminal 18 to the solenoid 4, the movable iron core 14 is attracted to the fixed iron core 2 against the biasing force of the compression spring 15.

A valve support cylinder 13 is connected at its base to the movable iron core 14. A spherical valve 11 is fixed to the front end of the valve support cylinder 13, and is designed to abut against a valve seat 10 formed at the front end portion of a valve housing 12. The valve support cylinder 13 is slidably supported in the valve housing 12. When the solenoid 4 is supplied with current, and the movable iron core 14 is attracted to the fixed iron core 2, the spherical valve 11 is moved rightwardly as viewed in FIG. 1A together with the valve support cylinder 13. As a result, the spherical valve 11 comes to separation from the valve seat 10 to allow the fuel to be injected from the injection nozzle. The valve support cylinder 13 is formed with a flange 13*a* at a base portion thereof. During the rightward movement of the valve support cylinder 13, the flange 13*a* comes to abutment against a stopper 7, thereby restricting the range of retraction of the valve support cylinder 13. Further, the injector 1 includes a nozzle cover 9 fixed to the front end portion of the injector casing 6, and includes O-ring seals 3, 5 and 8 for preventing fuel leakage. A fuel passage is formed in the vicinity of the axis of the body of the injector 1, and is connected through a strainer 17 to a fuel pump (not shown).

Figure 1B:
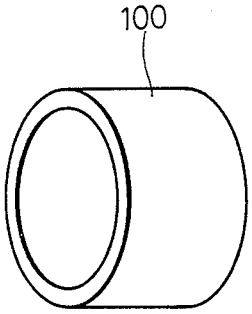
FIG. 1B is a perspective view of the radiation member shown in FIG. 1A.

FIG. 1B shows the cylindrical radiation cover 100 in perspection. The radiation cover 100 is closely fitted on the outer periphery of the injector casing 6 in substantially coextensive relationship with the solenoid coil 4. It will be understood from the following analysis and results of experiment that the cylindrical radiation cover has a radiating function.

Let r1 denote the radius of the solenoid coil 4; let r2 denote the radius of the injector casing 6; let r3 denote the radius of the cover 100; and let Q (calory) denote the calorific value of the solenoid coil 4 per hour, the following equations are given from a Newton's law of cooling, wherein a unit length in the axial direction is considered. When the cover 100 is absent:

$$Q=2\pi\alpha r2(T2'-Ta) \tag{1}$$

When the cover 100 is present:

$$Q=2\pi\alpha r3(T3-Ta) \tag{2}$$

Where, $\alpha$ is a surface heat transfer rate; Ta is an outside air temperature; T2' is a surface temperature of the injector casing 6 when the cover 100 is absent; and T3 is a surface temperature of the cover 100.

Next, a temperature profile in the cover 100 will be obtained under a steady state. Let r denote the radius of the cover 100, and let k3 denote the heat conductivity of aluminum, the following differential equation is given.

$$Q=-2\pi rk3dt/dr \tag{3}$$

Equation (3) is solved, and the boundary condition obtained from Equation (2) is substituted to give the following equation.

$$T(r) = Ta + \frac{Q}{2\pi\alpha r3} + \frac{Q}{2\pi k3}\cdot\ln(r3/r) \tag{4}$$

Temperature at the boundary between the injector casing and the cover is as follows:

$$T2 = Ta + \frac{Q}{2\pi\alpha r3} + \frac{Q}{2\pi k3}\cdot\ln(r3/r2) \tag{5}$$

Similarly, a temperature profile in the injector casing will be obtained by using Equation (5) for the boundary condition to give the following equation.

$$T(r) = Ta + \frac{Q}{2\pi\alpha r3} + \frac{Q}{2\pi k3}\cdot\ln(r3/r2) + \frac{Q}{2\pi k2}\cdot\ln(r2/r) \tag{6}$$

Where, k2 is a heat conductivity of the magnetic stainless steel.

Surface temperature of the solenoid is obtained from Equation (6) as follows:

$$T1 = Ta + \frac{Q}{2\pi\alpha r3} + \frac{Q}{2\pi k3}\cdot\ln(r3/r2) + \frac{Q}{2\pi k2}\cdot\ln(r2/r1) \tag{7}$$

Next, when the cover is absent, the temperature profile will be obtained in the same manner as the above to give the following equation.

$$T(r) = Ta + \frac{Q}{2\pi ar2} + \frac{Q}{2\pi k2} \cdot \ln(r2/r) \quad (8)$$

Hence, surface temperature of the solenoid is obtained as follows:

$$T1' = Ta + \frac{Q}{2\pi ar3} + \frac{Q}{2\pi k3} \cdot \ln(r3/r2) + \frac{Q}{2\pi k2} \cdot \ln(r2/r) \quad (9)$$

For the purpose of comparing the surface temperature of the solenoid when the cover is absent with that when the cover is present, Equation (7) is subtracted from Equation (9) to give the following equation.

$$T1' - T1 = \frac{Q}{2\pi}\left\{\left(\frac{1}{ar2} + \frac{1}{k3} \cdot \ln r2\right) - \left(\frac{1}{ar3} + \frac{1}{k3} \cdot \ln r3\right)\right\} \quad (10)$$

Then, the following equation is supposed.

$$f(r) = \frac{k3}{a} \cdot \frac{1}{r} + \ln r \quad (11)$$

In Equation (11), when the heat conductivity of aluminum is substituted into k3, and when the surface heat transfer rate under the condition where a wind of about 10 km/h strikes against a pipe is substituted into $\alpha$, the value of $k3/\alpha$ is approximately 0.05. This value is substituted into Equation (11), and a graph of Equation (11) is shown in FIG. 2.

Figure 2:
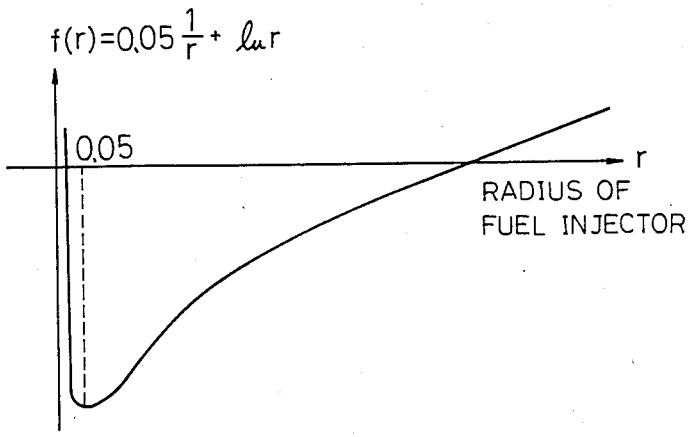
FIG. 2 is a graph showing a radiating function of the radiation member of the invention.

As is apparent from FIG. 2, f(r) is minimum at r=0.05 (meters). In the range of $r \leqq 50$ mm, f(r) is decreased with an increase in r. In contrast of this to Equation (10), the following equation is given.

$$T1' - T1 = \frac{Q}{2\pi k3}\{f(r2) - f(r3)\} \quad (12)$$

It will be appreciated that a radiation effect is obtained by the cover in the range of $r \leqq 50$ mm (r: radius of fuel injector), and the more the radius of the cover approaches 50 mm, the greater the effect is. As the outer diameter of the fuel injector of the preferred embodiment is about 21 mm, the above conditions are satisfied.

Figure 3:
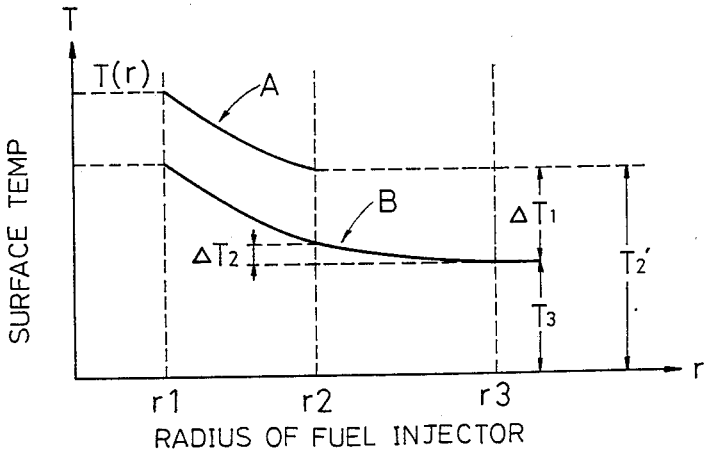
FIG. 3 is a graph showing a temperature distribution of the fuel injector and the radiation member.

Referring to FIG. 3, a curved line A is a graph showing the temperature profile under the condition where the cover is absent, that is, Equation (8), and a curved line B is a graph showing the temperature profile under the condition where the cover is present, that is, Equations (4) and (6). $\Delta T1$ represents a reduction in surface temperature of the injector due to an increase in surface area by the provision of the cover. $\Delta T2$ represents a temperature difference generated in the cover. It will be understood that the cover exhibits a radiating operation under the conditions where $\Delta T1$ is greater than $\Delta T2$. A high heat-conductive material for the cover is effective because $\Delta T2$ is small. The cover may be formed of copper or silver instead of aluminum.

In the experiment, several covers having different outer diameters were closely fitted on the outer periphery of the injector casing having an outer diameter of 21 mm. Then, the solenoid was continuously supplied with current for 30 minutes, and temperature at a point M shown in FIG. 1A was measured by a thermistor. The cover having a length of about 16 mm was slightly longer than the solenoid as shown in FIG. 1A. The measurement results are shown in Table below.

TABLE

| Cover | Cover Present (Outer Diameter (mm)) | | | | |
|---|---|---|---|---|---|
| Absent | 24 | 27 | 30 | 33 | 36 |
| 165° C. | 135° C. | 122° C. | 110° C. | 102° C. | 96° C. |

As will be apparent from Table, the cover functions as an effective radiation member.

Second Embodiment

Figure 4A:
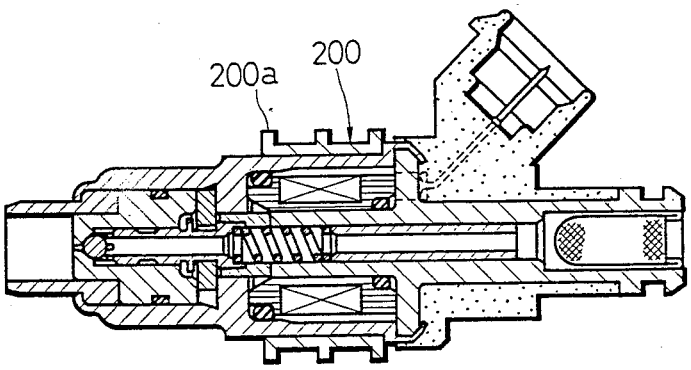
FIG. 4A is a vertical sectional view of the fuel injector of a second preferred embodiment.
Figure 4B:
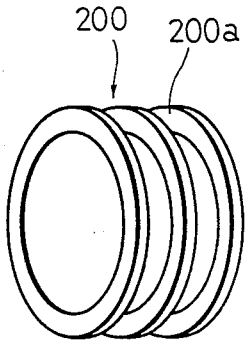
FIG. 4B is a perspective view of the radiation member shown in FIG. 4A.

As shown in FIGS. 4A and 4B, a radiation cover 200 is integrally formed with three circular radiation fins 200*a* radially projecting from the outer periphery thereof. The length of the cover 200 is equal to that of the cover 100 of the first embodiment. The outer diameter of each fin 200*a* is 30 mm, while the outer diameter of the other part is 23 mm. With this construction, temperature of the fuel injector was reduced to 105° C. This result shows an improvement in the radiation effect as compared with the first embodiment.

Third Embodiment

Figure 5A:
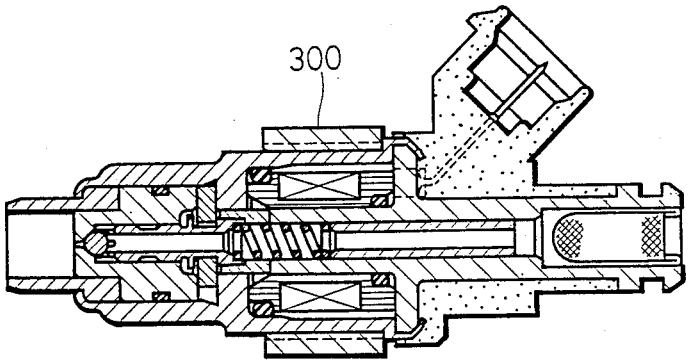
FIG. 5A is a vertical sectional view of the fuel injector of a third preferred embodiment.
Figure 5B:
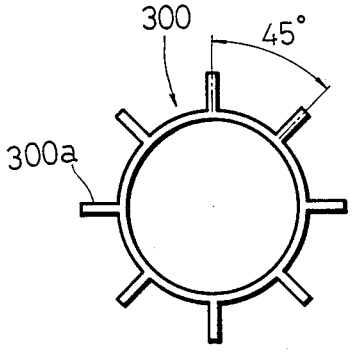
FIG. 5B is a perspective view of the radiation member shown in FIG. 5A.

As shown in FIGS. 5A and 5B, a radiation cover 300 is integrally formed with eight radiation fins 300*a* radially projecting from the outer periphery thereof. The radiation fins 300*a* are arranged at circumferentially equal intervals, and extend in the axial direction of the cover 300. As with the second embodiment, an outer diameter of each radiation fin 300*a* is 30 mm. With this construction, temperature of the fuel injector was reduced to 109° C. This embodiment exhibits a radiation effect almost the same as with the second embodiment.

Fourth Embodiment

Figure 6A:
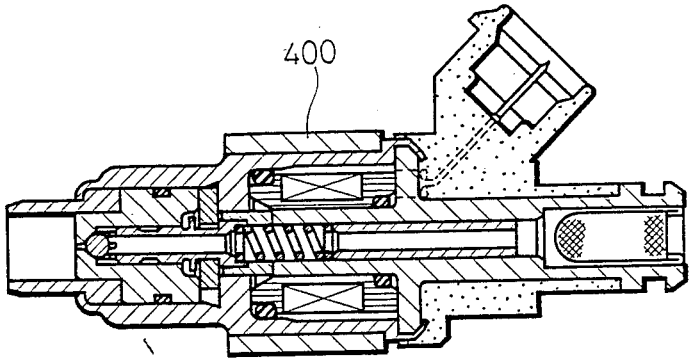
FIG. 6A is a vertical sectional view of the fuel injector of a fourth preferred embodiment.
Figure 6B:
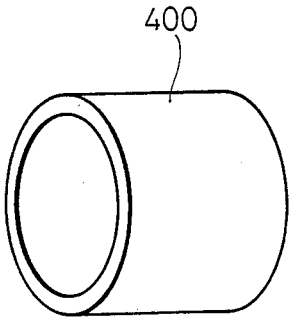
FIG. 6B is a perspective view of the radiation member shown in FIG. 6A.

As shown in FIGS. 6A and 6B, a radiation cover 400 is slightly longer than the radiation cover 100 of the first embodiment, so as to obtain a greater radiation effect as compared with the first embodiment. Naturally, the radiation cover 400 may be formed with the radiation fins as mentioned in the second and the third embodiment.

Fifth Embodiment

Figure 7A:
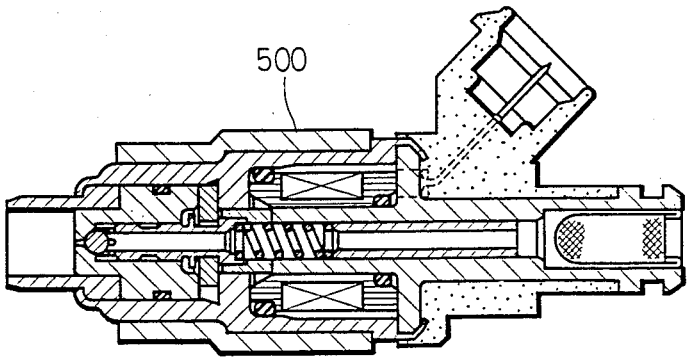
FIG. 7A is a vertical sectional view of the fuel injector of a fifth preferred embodiment.
Figure 7B:
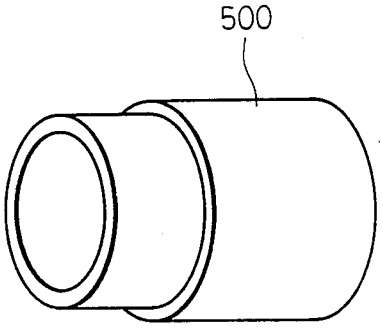
FIG. 7B is a perspective view of the radiation member shown in FIG. 7A.

As shown in FIGS. 7A and 7B, a radiation cover 500 is provided to surround substantially the entire length of the fuel injector. In this embodiment, the radiation cover 500 functions to radiate the heat generated from the solenoid at a part near the solenoid, and also radiate the heat transmitted from the internal combustion engine at a front portion of the fuel injector.

Accordingly, the radiation cover in this embodiment may prevent over-heating of the fuel injector both under a high-load operational condition where a large amount of heat is generated from the solenoid, and the internal combustion engine becomes hot, and under a stop condition just after the high-load operational condition. The radiation cover 500 may be formed with the radiation fins as previously mentioned.

Sixth Embodiment

Figure 8A:
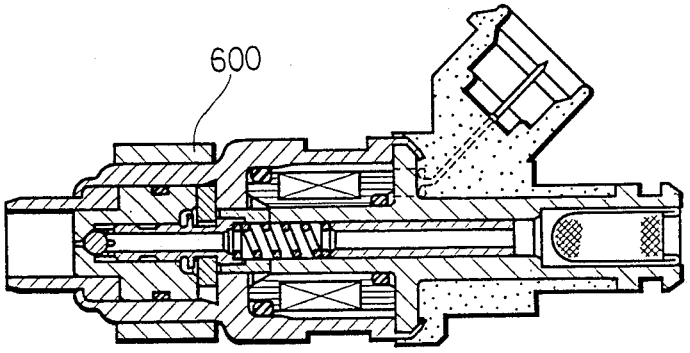
FIG. 8A is a vertical sectional view of the fuel injector of a sixth preferred embodiment.
Figure 8B:
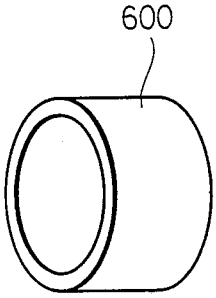
FIG. 8B is a perspective view of the radiation member shown in FIG. 8A.

As shown in FIGS. 8A and 8B, a radiation cover 600 is provided to surround the front portion of the fuel injector, so as to primarily prevent over-heating of the fuel injector due to the heat transmitted from the internal combustion engine. The radiation cover 600 may be formed with the radiation fins as previously mentioned.

Seventh Embodiment

Figure 9A:
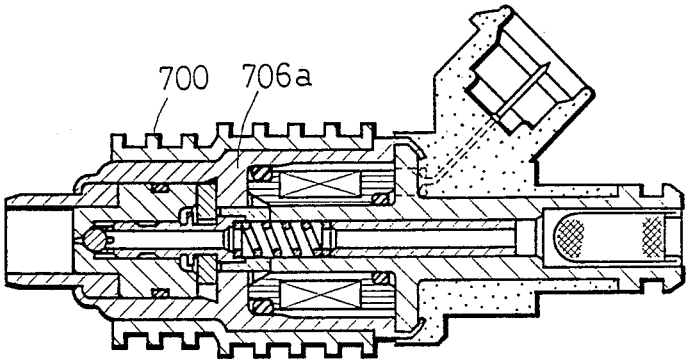
FIG. 9A is a vertical sectional view of the fuel injector of a seventh preferred embodiment.
Figure 9B:
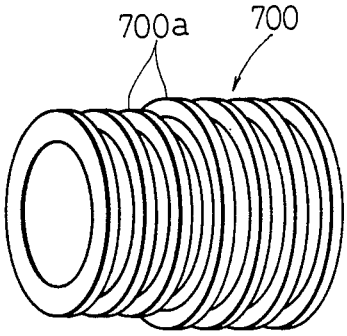
FIG. 9B is a perspective view of the radiation member shown in FIG. 9A.

As shown in FIGS. 9A and 9B, a radiation cover 700 is closely fitted on the outer periphery of an injector casing 706*a*. The radiation cover 700 is formed with a plurality of circular radiation fins 700*a*, so as to provide an increased surface area exposed to the atmosphere. The outer periphery of the injector casing 706*a* is smoothened to obtain tight contact with the radiation cover 700.

Eighth Embodiment

Figure 10A:
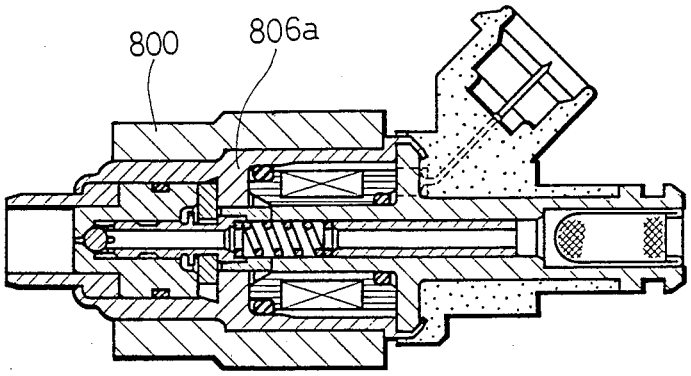
FIG. 10A is a vertical sectional view of the fuel injector of an eighth preferred embodiment.
Figure 10B:
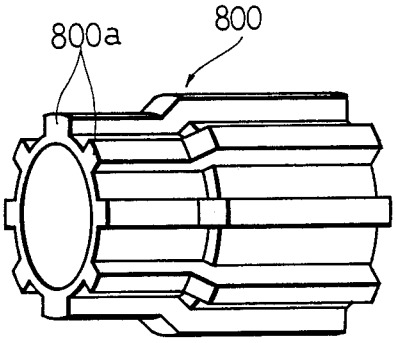
FIG. 10B is a perspective view of the radiation member shown in FIG. 10A.

As shown in FIGS. 10A and 10B, a radiation cover 800 having a plurality of axially extending radiation fins 800*a* is closely fitted on the outer periphery of an injector casing 806*a*. The increased surface area of the cover 800 exposed to the atmosphere is provided by the radiation fins 800*a*. The outer periphery of the injector casing 806*a* is smoothened to obtain tight contact with the radiation cover 800.

Ninth Embodiment

Figure 11A:
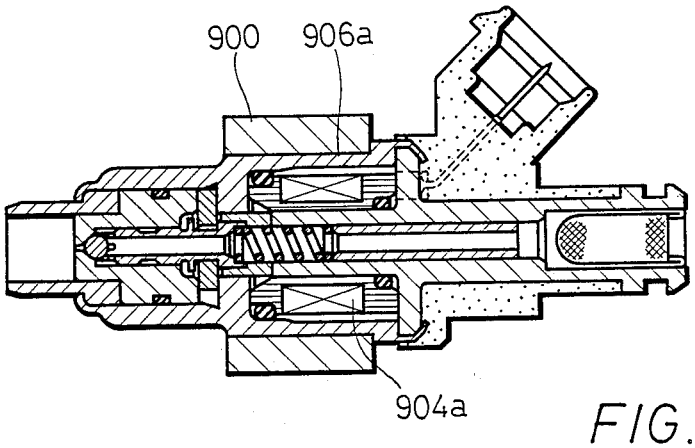
FIG. 11A is a vertical sectional view of the fuel injector of a ninth preferred embodiment.
Figure 11B:
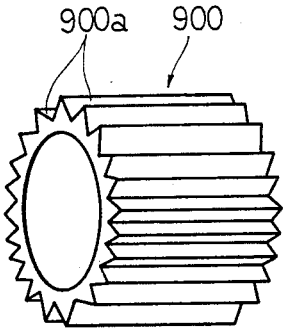
FIG. 11B is a perspective view of the radiation member shown in FIG. 11A.

As shown in FIGS. 11A and 11B, a radiation cover 900 having a plurality of axially extending V-shaped grooves 900*a* is closely fitted on the outer periphery of an injector casing 906*a* in the vicinity of a solenoid coil 904*a*. The increased surface area of the radiation cover 900 exposed to the atmosphere is provided by the V-shaped grooves 900*a*. The outer periphery of the injector casing 906*a* covered with the radiation cover 900 is smoothened to obtain tight contact with the cover 900. This embodoment is particularly effective to radiate the heat generated from the solenoid coil 904*a*.

The form of the radiation cover as mentioned in the previous embodiments is illustrative and not restrictive, and any modified forms may be included in the present invention. The radiation cover for covering the front portion of the injector is effective in the case that the heat transmitted from the internal combustion engine is large under a high-load operational condition for a long time, or a stop condition just after the high-load operational condition, for example. On the other hand, the radiation cover for covering a part of the injector casing in the vicinity of the solenoid is particularly effective in the case that the heat generated from the solenoid is large under the high-load operational condition. Further, the radiation cover for covering the entire length of the injector casing is effective in both the above cases.

Although the radiation cover is preferably formed of a high heat-conductive material such as aluminum or copper, it may be formed of surface-treated steel. In using such a high heat-conductive material, over-heating of the fuel injector may be prevented even when the surface area of the radiation cover exposed to the atmosphere is relatively small.

Referring to FIGS. 12 to 16, the radiation cover of the present invention also acts as a connection member for connecting the fuel injectors mounted on the cylinders of a multi-cylinder engine.

Tenth Embodiment

Figure 12:
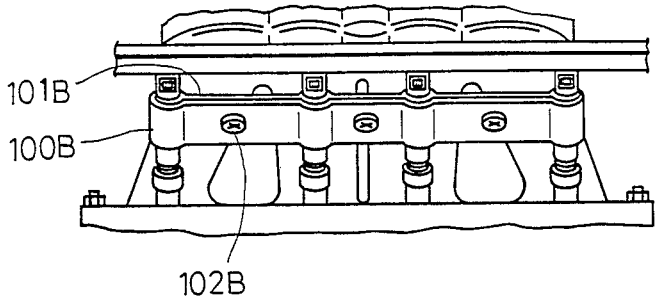
FIG. 12 is a perspective view of the radiation member as the connection member for connecting the fuel injectors mounted on the cylinders of the multi-cylinder engine of a tenth preferred embodiment.

As shown in FIG. 12, the fuel injectors are held by two connecting members 100B and 101B secured to each other by bolts 102B. In this embodiment, as a sufficient radiation effect cannot be obtained as compared with twelfth and thirteenth embodiments to be hereinafter described, the connection member is preferably formed of a high heat-conductive material such as aluminum, copper or alloy thereof.

Eleventh Embodiment

Figure 13:
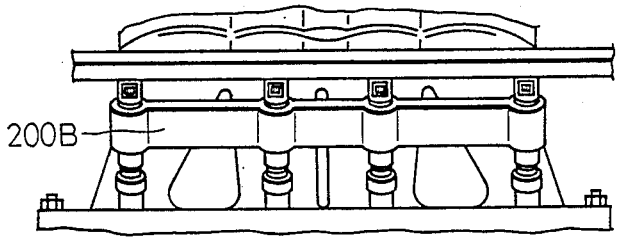
FIG. 13 is a perspective view of the radiation member of an eleventh preferred embodiment.

As shown in FIG. 13, a connection member 200B is formed with through-holes into which the fuel injectors are fixedly inserted to be connected with each other. The fuel injectors are fixed to the connecting member by press-fitting, caulking, laser welding or the like. In this embodiment, the connecting member 200B is also preferably formed with a high heat-conductive material.

Twelfth Embodiment

Figure 14:
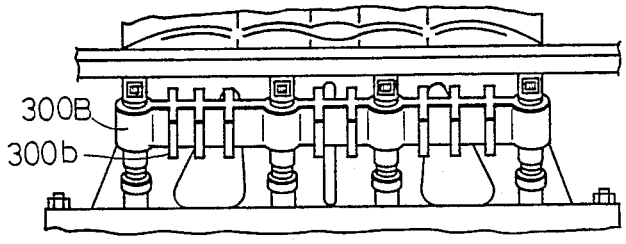
FIG. 14 is a perspective view of the radiation member of a twelfth preferred embodiment.

As shown in FIG. 14, a connection member 300B is formed with a plurality of radiation fins 300*b* projecting from both sides at right angles to the longitudinal direction. In this embodiment, as a sufficient radiation area may be obtained by the radiation fins 300*b*, the connection member 300B is not necessarily formed of a high heat-conductive material, but it may be formed of steel.

Thirteenth Embodiment

Figure 15A:
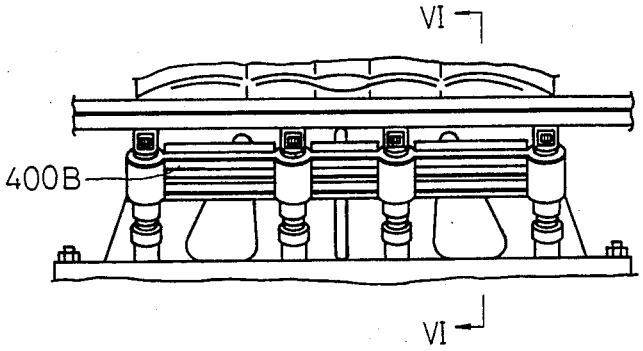
FIG. 15A is a perspective view of the radiation member of a thirteenth preferred embodiment.
Figure 15B:
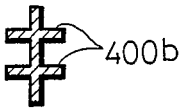
FIG. 15B is a cross-sectional view taken along the line VI—VI in FIG. 15A.

As shown in FIGS. 15A and 15B, a connection member 400B is formed with two pairs of radiation fins 400*b* projecting from both sides and extending in the longitudinal direction. In this embodiment, since a sufficient radiation area may be obtained by the radiation fins 400*b*, the connecting member may be formed of steel.

Although the connection member as mentioned in the twelfth and thirteenth embodiments is of the type where the injectors are fixedly inserted into through-holes, it may be formed by two connecting members secured by bolts in the same manner as in FIG. 12.

Figure 16:
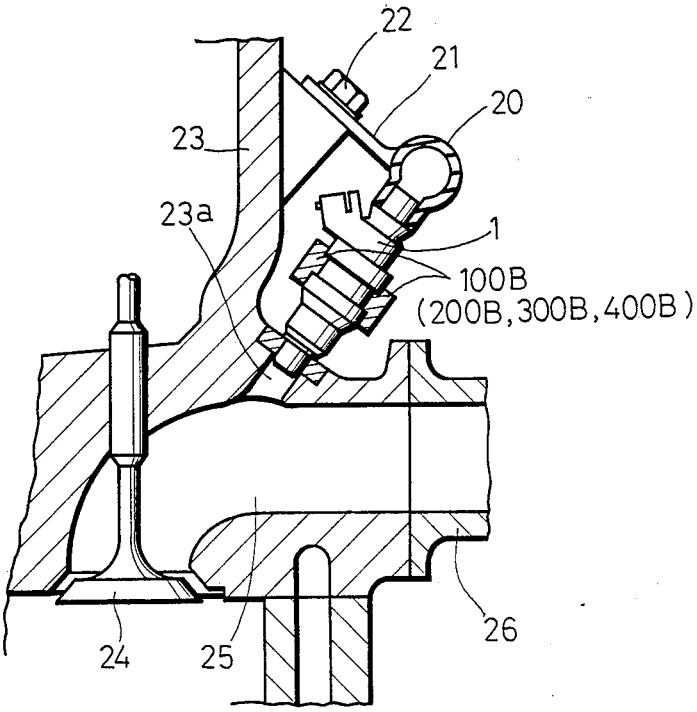
FIG. 16 is a sectional view of the fuel injectors mounted on the multi-cylinder engine.

As shown in FIG. 16, the fuel injectors 1 are mounted on a cylinder head 23 of the internal combustion engine. The cylinder head 23 is formed with mounting holes 23*a* communicated with suction passages 25 leading to the cylinders. Each of the fuel injectors 1 is mounted on the cylinder head 23 by fixedly inserting the nozzle cover 9 into the mounting hole 23*a*. Each of the suction passages 25 is communicated at one end through each of suction valves 24 to each of the cylinders, and is connected at the other end to each of suction pipes 26. The strainer of the fuel injector is connected to a delivery pipe 20 having a stay 21. The stay 21 is fixed to the cylinder head 23 by a bolt 22.

In the tenth to thirteenth embodiments, the connection member 100B (200B, 300B, 400B) is mounted to surround the outer periphery of the fuel injector 1, so that a wide contact area between the connection member and the fuel injector 1 may be provided.

The mounting structure of the fuel injector in the present invention is not limited to the aforementioned embodiments. For instance, the connecting member may be formed with corrugated radiation fins so as to increase a radiation area. Further, two or more connection members may be provided to connect the fuel injectors.

The connection member may be mounted on the fuel injectors at desired positions such as at the front portion or the central portion of the fuel injectors, or over the entire length thereof. In the case where the connecting member is mounted at the front portion of the fuel injectors, it is effective to radiate the heat transmitted from the internal combustion engine. In the case where the connecting member is mounted at the central portion of the fuel injectors, it is effective to radiate the heat generated from the soleloid coil.

Having thus described the preferred embodiments of the invention, it should be understood that numerous structural modifications and adaptations may be made without departing from the spirit of the invention.

We claim:

1. In an electromagnetic fuel injector with injector nozzle means receivable within an internal combustion engine, said injector comprising a fixed iron core, a solenoid formed by winding a coil around said fixed iron core, an injector casing surrounding said solenoid and formed of a material having high magnetic permeability, a movable iron core inserted between said fixed iron core and said injector casing, a compression spring normally biasing said movable iron core toward said injection nozzle means of said injector, a valve body connected to said movable iron core, a valve housing incorporated in a front portion of said injector casing and slidably supporting said valve body, said valve housing being formed at its front end portion with a valve seat adapted to abut against said valve body, the improvement comprising a radiation member closely fitted in heat conductive engagement on an outer periphery of said injector casing at at least a front portion of said injector casing located outward of said nozzle means for location externally of said engine in order to dissipate heat from said injector.

2. The electromagnetic fuel injector as defined in claim 1, wherein said radiation member comprises a cylindrical member having high heat conductivity.

3. The electromagnetic fuel injector as defined in claim 1, wherein said radiation member is integrally formed with a radiation fin on an outer periphery thereof.

4. The electromagnetic fuel injector as defined in claim 1, wherein said radiation member is mounted over substantially the entire length of said injector casing.

5. The electromagnetic fuel injector as defined in claim 1 wherein said solenoid coil is of a finite length, said radiation member maintaining conductive engagement with said injector casing a significant distance beyond said coil.

6. The electromagnetic fuel injector as defined in claim 1 wherein said radiation member is in substantially coextensive relationship with said solenoid.

7. An assembly comprising electromagnetic fuel injectors mounted on a multi-cylinder engine, each injector comprising a fixed iron core, a solenoid formed by winding a coil around said fixed iron core, an injector casing surrounding said solenoid and formed of a material having high magnetic permeability, a movable iron core inserted between said fixed iron core and said injector casing, a compression spring normally biasing said movable iron core toward an injection nozzle of said injector, a valve body connected to said movable iron core, a valve housing incorporated in a front portion of said injector casing and slidably supporting said valve body, said valve housing being formed at its front end portion with a valve seat adapted to abut against said valve body; and a connection means externally of said engine extending longitudinally between said fuel injectors and in heat conducting intimate engagement therewith for connecting said fuel injectors and radiating heat from said fuel injectors.

8. The assembly as defined in claim 7, wherein said connecting means is formed of a high heat-conductive material.

9. The assembly as defined in claim 7, wherein said connection means comprises an elongate member extending between and connecting all of said fuel injectors.

10. The assembly as defined in claim 9, wherein said elongate member includes through-holes into which said fuel injectors are fixedly inserted.

11. The assembly as defined in claim 7 wherein said connection means comprised first and second elongate members positioned generally parallel to each other and engaging said fuel injectors therebetween.

12. The assembly as defined in claim 7, wherein said connection means includes a plurality of fins.

13. The assembly as defined in claim 12, wherein said fins project at right angles to the longitudinal direction of said connection means.

14. The assembly as defined in claim 12, wherein said fins project laterally of said connection means and extend longitudinally therealong.

* * * * *